US010741371B1

(12) United States Patent
Sugiura et al.

(10) Patent No.: US 10,741,371 B1
(45) Date of Patent: Aug. 11, 2020

(54) ELECTRON TUBE MODULE AND OPTICAL DEVICE

(71) Applicant: HAMAMATSU PHOTONICS K.K., Hamamatsu-shi, Shizuoka (JP)

(72) Inventors: Ginji Sugiura, Hamamatsu (JP); Yasumasa Matsuoka, Hamamatsu (JP); Shunsuke Kobayashi, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 16/782,205

(22) Filed: Feb. 5, 2020

(30) Foreign Application Priority Data

Feb. 7, 2019 (JP) ..... 2019-020471

(51) Int. Cl.

| | |
|---|---|
| ***H01J 43/22*** | (2006.01) |
| ***H01J 43/12*** | (2006.01) |
| ***H01J 31/48*** | (2006.01) |
| ***H01J 43/08*** | (2006.01) |

(52) U.S. Cl.
CPC ..... *H01J 43/22* (2013.01); *H01J 31/48* (2013.01); *H01J 43/08* (2013.01); *H01J 43/12* (2013.01)

(58) Field of Classification Search
CPC .. H01J 43/22; H01J 43/08; H01J 43/12; H01J 31/48
See application file for complete search history.

(56) References Cited

U.S. PATENT DOCUMENTS

| | | | | |
|---|---|---|---|---|
| 3,873,829 | A | 3/1975 | Evrard et al. | |
| 2009/0236985 | A1* | 9/2009 | Sugiyama ..... | H01J 5/24 313/532 |
| 2009/0283290 | A1* | 11/2009 | Shimoi ..... | H01J 5/24 174/50.5 |

FOREIGN PATENT DOCUMENTS

| | | |
|---|---|---|
| JP | 3620925 B2 | 2/2005 |
| JP | 5291378 B2 | 9/2013 |

OTHER PUBLICATIONS

W.D. Gunter, Jr., et al. "Optical Devices to Increase Photocathode Quantum Efficiency," Applied Optics, vol. 9, No. 2 (Feb. 1970), pp. 251-257.

* cited by examiner

*Primary Examiner* — Joseph L Williams
(74) *Attorney, Agent, or Firm* — Faegre Drinker Biddle & Reath LLP

(57) ABSTRACT

An electron tube module includes an electron tube and a casing. The electron tube includes a vacuum container with a light transmitting substrate, a photocathode provided in an inner surface of the light transmitting substrate, an anode, and a prism. The prism includes a first surface bonded to an outer surface of the light transmitting substrate, a second surface inclined with respect to the first surface, and a third surface which further reflects light incident to the photocathode through the prism and the light transmitting substrate and reflected at an interface between the photocathode and a vacuum space so that the light is incident to the photocathode again. The casing includes a ceiling wall provided with an opening. The second surface is parallel to the ceiling wall. At least a part of the second surface is exposed to outside through the opening.

9 Claims, 10 Drawing Sheets

ELECTRON TUBE MODULE AND OPTICAL DEVICE

TECHNICAL FIELD

The present disclosure relates to an electron tube module and an optical device.

BACKGROUND

Conventionally, there is known an electron tube such as a photomultiplier tube which detects weak light such as fluorescence generated from a sample. The electron tube includes a vacuum container with a light transmitting substrate and a photocathode provided on a vacuum side inner surface of the light transmitting substrate. Non Patent Literature 1 (W. D. Gunter, Jr., G. R. Grant, and S. A. Shaw. Optical devices to increase photocathode quantum efficiency. APPLIED OPTICS Vol. 9, No. 2 251-257 (1970)) discloses a configuration in which a prism is provided in an outer surface of a light transmitting substrate provided with such a photocathode. In this configuration, light incident to an incident surface of the prism is totally reflected at an interface between the photocathode and a vacuum space and then is further reflected at a surface on the side opposite to the incident surface of the prism so as to return to the photocathode. Accordingly, the quantum efficiency (QE) of the photocathode is improved.

SUMMARY

Incidentally, in the above-described electron tube, the incident surface of the prism and the axial direction (that is, a direction orthogonal to the photocathode) of the electron tube are inclined with respect to each other. For this reason, it is necessary to adjust the angle of the incident surface which is not necessary in the conventional configuration not using the prism as for the arrangement of the electron tube inside the optical device. Specifically, in the conventional configuration, the electron tube may be disposed so that the optical axis of the detection target light matches the axial direction of the electron tube. However, when the electron tube with the prism is used, the axial direction of the electron tube needs to be inclined with respect to the optical axis of the detection target light so that the incident surface of the prism is orthogonal to the optical axis of the detection target light. For this reason, the arrangement of the electron tube is not intuitive and may be complicated compared to the conventional case.

Therefore, an object of the present disclosure is to provide an electron tube module and an optical device capable of facilitating an operation of disposing an electron tube provided with a prism on a light transmitting substrate.

An electron tube module according to an aspect of the present disclosure includes: an electron tube; and a casing which accommodates the electron tube, in which the electron tube includes a vacuum container which includes a light transmitting substrate and forms a vacuum space, a photocathode which is provided in an inner surface corresponding to a surface on the side of the vacuum space of the light transmitting substrate and emits photoelectrons into the vacuum space in response to the light incident through the light transmitting substrate, an electron detector which is provided inside the vacuum container and detects electrons derived from the photoelectrons, and a prism which is bonded to an outer surface on the side opposite to the inner surface of the light transmitting substrate, in which the prism includes a first surface which is bonded to the outer surface of the light transmitting substrate, a second surface which is a light incident surface inclined with respect to the first surface, and a reflection portion which further reflects light incident to the photocathode through the prism and the light transmitting substrate and reflected at an interface between the photocathode and the vacuum space so that the light is incident to the photocathode again, in which the casing includes a wall portion provided with an opening, in which the second surface of the prism is parallel to the wall portion, and in which at least a part of the second surface of the prism is exposed to the outside through the opening.

According to the electron tube module, the detection target light incident from the second surface of the prism and transmitted through the prism and the light transmitting substrate can be reflected at the interface between the photocathode and the vacuum space and the reflected light can be further reflected at the reflection portion so as to be incident to the photocathode again. Accordingly, it is possible to increase the absorption amount of the detection target light in the photocathode. Further, since the electron tube is accommodated in the casing so that the second surface of the prism is parallel to the wall portion and at least a part of the second surface of the prism is exposed to the outside through the opening, the electron tube module can be easily disposed. Specifically, since the position of the electron tube module is adjusted so that the wall portion of the casing is orthogonal to the optical axis of the detection target light, it is possible to easily and appropriately dispose the electron tube module. Thus, according to the electron tube module, it is possible to facilitate the operation of disposing the electron tube provided with the prism in the light transmitting substrate.

The second surface of the prism may be in contact with an inner surface of the wall portion. Since the second surface of the prism is brought into contact with the inner surface of the wall portion of the casing, it is possible to easily and highly accurately position the electron tube inside the casing.

The second surface of the prism may be bonded to the inner surface of the wall portion. In this case, since the prism is fixed to the wall portion of the casing, it is possible to appropriately prevent the positional deviation of the electron tube with respect to the wall portion.

The reflection portion may be configured by a third surface which is connected to the first surface and the second surface and is inclined with respect to the first surface and the second surface and the prism may be formed in a triangular prism shape of which the first surface, the second surface, and the third surface are side surfaces. In this case, it is possible to relatively simplify the shape of the prism and to further reflect the light reflected at the interface between the photocathode and the vacuum space by the third surface so as to be incident to the photocathode again.

The third surface may be provided with a reflection film. In this case, it is possible to reduce the transmission loss of the light (an element which is transmitted from the third surface to the outside) in the third surface by the reflection film. Accordingly, since it is possible to suppress a decrease in amount of the light reflected at the third surface and incident to the photocathode again, it is possible to effectively improve the quantum efficiency of the photocathode.

The electron tube may further include an electron multiplying unit which is provided inside the vacuum container and multiplies the photoelectrons. Alternatively, the electron detector may be a semiconductor element which multiplies the photoelectrons. According to the above-described configuration, it is possible to appropriately detect electrons in response to the detection target light in the electron detector even when the detection target light is weak light (such as fluorescence and Raman scattered light generated secondarily by irradiating a sample to be measured with excitation light).

An optical device according to an aspect of the present disclosure includes the electron tube module and a light source which outputs light irradiating a sample of a measurement object, in which the electron tube module is disposed so that detection target light generated in the sample when the sample is irradiated with the light is incident to the second surface of the prism through the opening of the wall portion.

The optical device has the same effect as that of the electron tube module by including the electron tube module as a detector that detects the detection target light.

In the optical device, the electron tube module may be configured so that the detection target light incident to the photocathode through the prism and the light transmitting substrate is totally reflected at an interface between the photocathode and the vacuum space. According to the above-described configuration, it is possible to increase the absorption amount of the detection target light of the photocathode by the detection target light returning to the photocathode again after the total reflection and to effectively improve the quantum efficiency of the photocathode.

According to the present disclosure, it is possible to provide an electron tube module and an optical device capable of facilitating an operation of disposing an electron tube provided in a prism on a light transmitting substrate.

DETAILED DESCRIPTION

Figure 3:
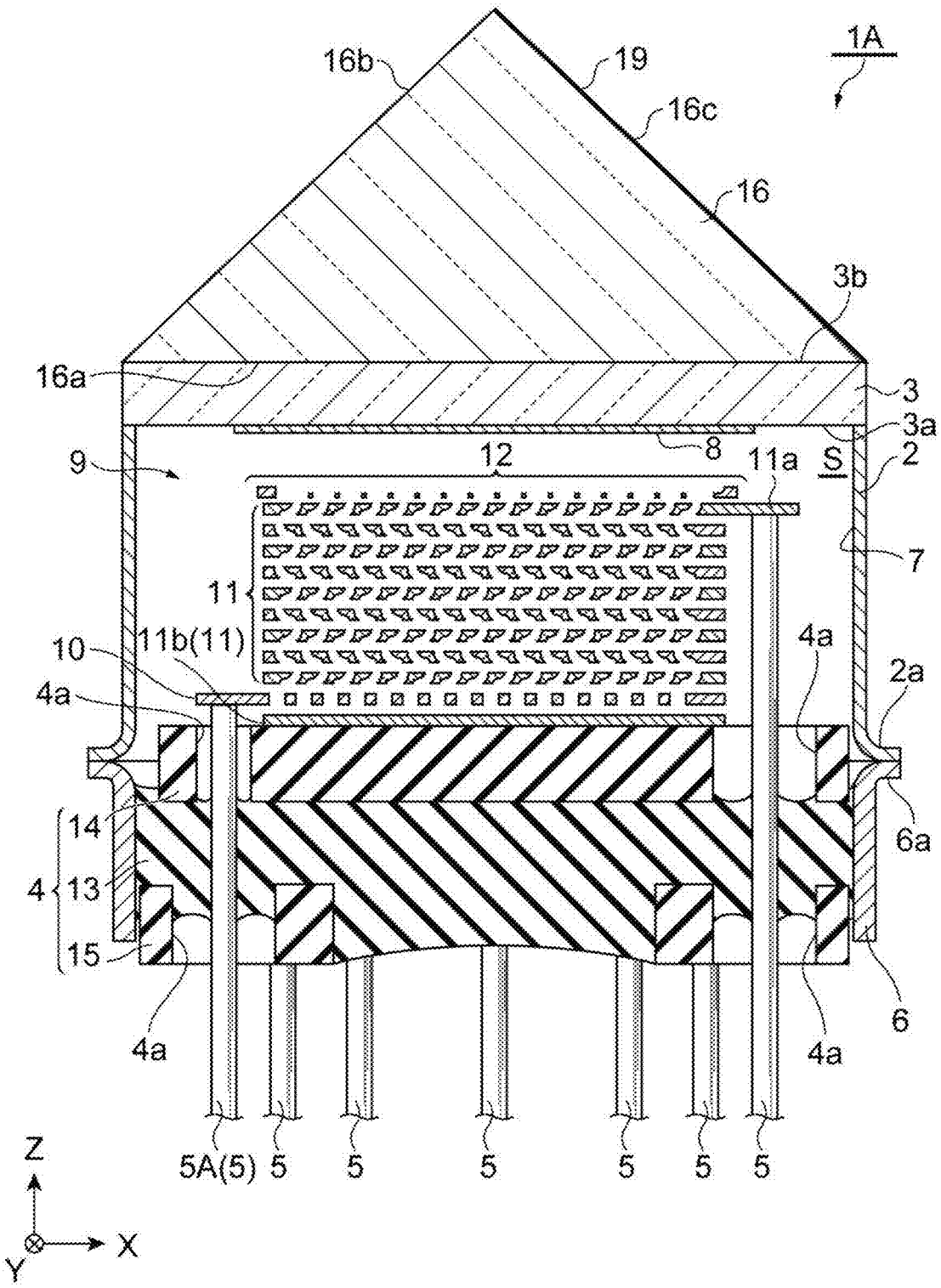
FIG. 3 is a cross-sectional view of an electron tube accommodated in the electron tube module.
Figure 4:
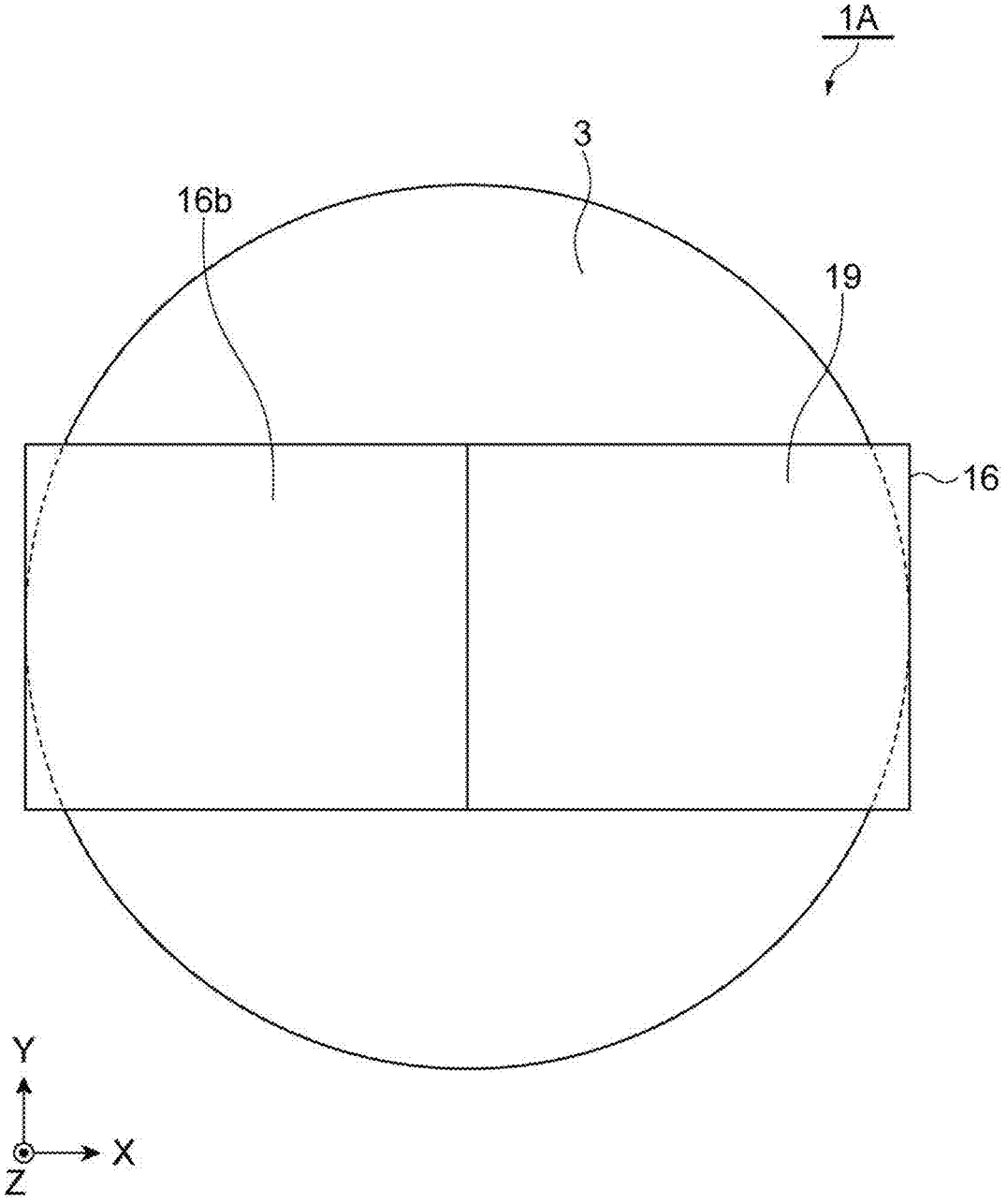
FIG. 4 is a plan view of the electron tube illustrated in FIG. 3.

Hereinafter, an embodiment of the present disclosure will be described with reference to the drawings. In the drawings, the same or equivalent parts will be denoted by the same reference numerals and a redundant description thereof will be omitted. Furthermore, in the drawings, a part or characteristic part is exaggerated for easy understanding and is different from actual dimensions. Further, in the description below, terms such as "upper" and "lower" are for convenience based on the state illustrated in the drawings. In FIGS. 3 and 4, an XYZ coordinate is illustrated for convenience of description.

Figure 1:
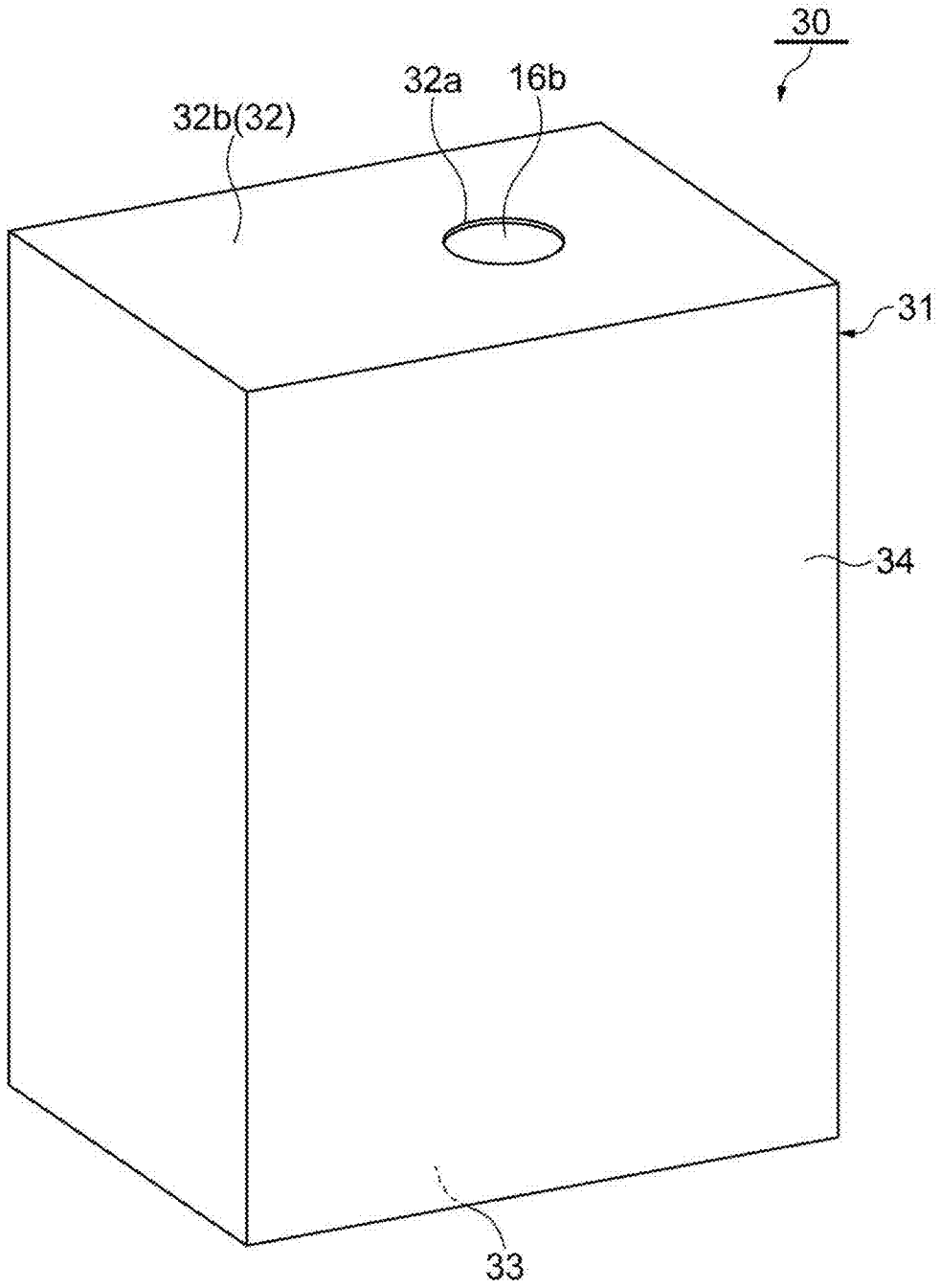
FIG. 1 is a perspective view of an electron tube module according to an embodiment.
Figure 2:
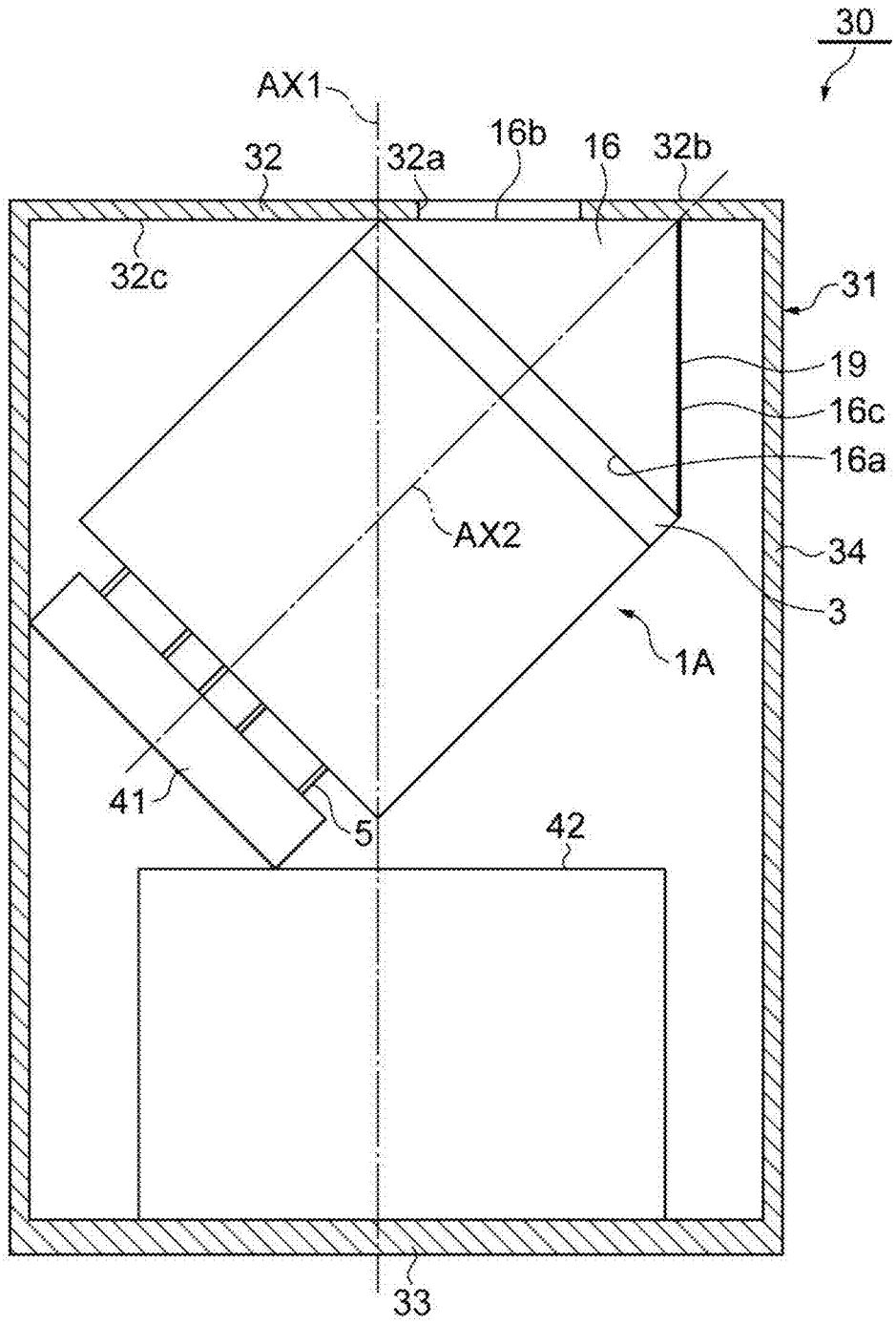
FIG. 2 is a partially cross-sectional view of the electron tube module.

As illustrated in FIGS. 1 and 2, an electron tube module 30 according to an embodiment includes an electron tube 1A and a casing 31 which accommodates the electron tube 1A. The casing 31 is formed in a substantially rectangular parallelepiped shape. The casing 31 is formed of, for example, metal, resin, or the like. The casing 31 includes a ceiling wall 32 (a wall portion), a bottom wall 33, and a side wall 34. The ceiling wall 32 and the bottom wall 33 face each other in a direction along a central axis AX1 of the casing 31. The ceiling wall 32 and the bottom wall 33 are formed in a rectangular plate shape of the same size as viewed from the direction along the central axis AX1. The side wall 34 is formed in a rectangular tube shape extending along the central axis AX1 and connects the edge portion of the ceiling wall 32 and the edge portion of the bottom wall 33 to each other.

As illustrated in FIG. 2, in this embodiment, a circuit board 41 supplying a voltage to the electron tube 1A through a stem pin 5 and a booster circuit 42 connected to the circuit board 41 and configured to generate a high voltage to be supplied to the electron tube 1A are accommodated in the casing 31 together with the electron tube 1A. The electron tube 1A is disposed and fixed inside the casing 31 so that a central axis AX2 of the electron tube 1A is inclined with respect to the central axis AX1 of the casing 31.

The ceiling wall 32 is provided with an opening 32*a* which guides detection target light to the electron tube 1A (a second surface 16*b* of a prism 16 to be described later) inside the casing 31. The opening 32*a* penetrates from an outer surface 32*b* to an inner surface 32*c* of the ceiling wall 32. In this embodiment, the opening 32*a* is formed in a circular shape as viewed from the direction along the central axis AX1.

As illustrated in FIGS. 3 and 4, the electron tube 1A is a photomultiplier tube having an electron multiplying function (an electron multiplying unit 9 to be described later). The electron tube 1A includes a metallic side tube 2 having a substantially cylindrical shape. A light transmitting substrate 3 having good light transmission with respect to the incident light (the detection target light) is airtightly fixed to the upper end portion of the side tube 2. In this embodiment, the light transmitting substrate 3 is formed in a disk shape and the peripheral edge portion of the light transmitting substrate 3 is fixed to the upper end portion of the side tube 2. A disk-shaped stem 4 is disposed at the lower opening end of the side tube 2. A plurality of conductive stem pins 5 which are disposed in the circumferential direction at intervals are airtightly inserted into the stem 4 at the substantially circumferential positions. Each stem pin 5 is inserted through openings 4*a* formed at the corresponding positions on the upper surface side and the lower surface side of the stem 4. Further, a metallic ring-shaped side tube 6 is airtightly fixed so as to surround the stem 4 from the lateral side. A flange portion 2*a* formed at the lower end portion of the side tube 2 and a flange portion 6*a* formed at the upper end portion of the ring-shaped side tube 6 are welded to each other so that the side tube 2 and the ring-shaped side tube 6 are airtightly fixed to each other. In this way, a vacuum container 7 of which an inside is maintained in a vacuum state is formed by the side tube 2, the light transmitting substrate 3, and the stem 4.

A photocathode 8, the electron multiplying unit 9, and an anode 10 (an electron detector) are provided inside the vacuum container 7. The photocathode 8 is provided in an inner surface 3*a* on the side of the vacuum space S in the light transmitting substrate 3.

The photocathode 8 emits photoelectrons to the vacuum space S in response to light incident through the light transmitting substrate 3. The photocathode 8 is a so-called transmissive photocathode, receives light at the upper surface on the side of the light transmitting substrate 3, and emits photoelectrons from the lower surface on the side of the vacuum space S. The photocathode 8 can be formed of, for example, a material such as GaAsP, GaAs, and InGaAs. Alternatively, the photocathode 8 may be a bi-alkali photocathode or a multi-alkali photocathode.

Here, it is desirable that the thickness of the photocathode 8 is large to increase the absorption amount of the detection target light in the photocathode 8. Meanwhile, it is desirable that the thickness of the photocathode 8 is small to improve the electron emission efficiency from the photocathode 8 to the vacuum space S. Since the electron tube 1A can effectively increase the absorption amount of the detection target light in the photocathode 8 by including the prism 16 and the lens 17 to be described later, it is possible to decrease the thickness of the photocathode 8 accordingly. Based on the above, when the photocathode 8 is formed of GaAsP, GaAs, or InGaAs, the film thickness of the photocathode 8 may be 3 μm or less. Further, when the photocathode 8 a bi-alkali photocathode or a multi-alkali photocathode, the film thickness of the photocathode 8 may be 0.5 μm or less.

The electron multiplying unit 9 multiplies photoelectrons emitted from the photocathode 8. In this embodiment, the electron multiplying unit 9 is formed in a block shape by stacking a thin plate-shaped dynode plate 11 having a plurality of electron multiplying holes in a plurality of stages and is installed on the upper surface of the stem 4. The edge portion of each dynode plate 11 is provided with a dynode plate connection piece 11*a* which protrudes outward. A front end portion of a predetermined stem pin 5 inserted and attached to the stem 4 is welded and fixed to the lower surface side of each dynode plate connection piece 11*a*. Accordingly, each dynode plate 11 is electrically connected to each stem pin 5.

The anode 10 detects electrons derived from photoelectrons emitted from the photocathode 8. Here, electrons derived from photoelectrons emitted from the photocathode 8 may be photoelectrons itself or electrons generated secondarily based on the photoelectrons. In this embodiment, the anode 10 detects secondary electrons (that is, electrons secondarily generated based on photoelectrons emitted from the photocathode 8) multiplied by the electron multiplying unit 9. In this embodiment, the anode 10 is provided at a stage one higher than the dynode plate 11*b* at the final stage and is configured as a flat plate-shaped anode member for taking out secondary electrons emitted from the dynode plate 11*b* at the final stage.

A flat plate-shaped converging electrode 12 which converges photoelectrons emitted from the photocathode 8 to the electron multiplying unit 9 is provided between the photocathode 8 and the electron multiplying unit 9. The stem pin 5 is welded and fixed to the converging electrode 12 (not illustrated). Accordingly, the converging electrode 12 is electrically connected to the stem pin 5. Further, one anode pin 5A of the stem pin 5 is welded and fixed to the anode 10. Accordingly, the anode 10 is electrically connected to the anode pin 5A. Then, a voltage is applied by the stem pin 5 connected to a power circuit (for example, the circuit board 41 illustrated in FIG. 9) so that the photocathode 8 and the converging electrode 12 have the same potential and a potential becomes higher as it goes from the upper stage toward the lower stage of each dynode plate 11. Further, a voltage is applied to the anode 10 so that the potential becomes higher than that of the dynode plate 11*b* at the final stage.

The stem 4 is formed in a three-layer structure by a base material 13, an upper pressing material 14 bonded to the upper side (the inner side) of the base material 13, and a lower pressing material 15 bonded to the lower side (the outer side) of the base material 13. The ring-shaped side tube 6 is fixed to the side surface of the stem 4. In this embodiment, the side surface of the base material 13 and the inner wall surface of the ring-shaped side tube 6 are bonded to each other so that the stem 4 is fixed to the ring-shaped side tube 6.

The electron tube 1A includes the prism 16 outside the vacuum container 7. The prism 16 is bonded to an outer surface 3*b* on the side opposite to an inner surface 3*a* of the light transmitting substrate 3. The prism 16 includes a first surface 16*a*, a second surface 16*b*, and a third surface 16*c*. Each of the first surface 16*a*, the second surface 16*b*, and the third surface 16*c* is formed in a rectangular shape. All of the first surface 16*a*, the second surface 16*b*, and the third surface 16*c* are flat surfaces. The prism 16 is formed in a triangular prism shape of which a first surface 16*a*, a second surface 16*b*, and a third surface 16*c* are side surfaces. Specifically, the second surface 16*b* is connected to one end of the first surface 16*a* in the longitudinal direction (X-axis direction) and the third surface 16*c* is connected to the other end of the first surface 16*a* in the longitudinal direction. An end portion on the side opposite to the connection side to the first surface 16*a* of the second surface 16*b* is connected to an end portion on the side opposite to the connection side to the first surface 16*a* of the third surface 16*c*. In this embodiment, a bottom surface of the prism 16 (a surface of the prism 16 perpendicular to the longitudinal direction (Y-axis direction)) is formed in a right-angled isosceles triangle shape in which the second surface 16*b* and the third surface 16*c* are orthogonal to each other.

The first surface 16*a* is bonded to the outer surface 3*b* of the light transmitting substrate 3. The second surface 16*b* is inclined with respect to the first surface 16*a*. The second surface 16*b* is a light incident surface into which the detection target light is incident. The third surface 16*c* is connected to the first surface 16*a* and the second surface 16*b* and is inclined with respect to the first surface 16*a* and the second surface 16*b*. The third surface 16*c* serves as a reflection portion which further reflects light incident to the photocathode 8 through the prism 16 and the light transmitting substrate 3 and reflected at the interface between the photocathode 8 and the vacuum space S so that the light is incident to the photocathode 8 again. The first surface 16*a* of the prism 16 and the outer surface 3*b* of the light transmitting substrate 3 are bonded to each other by, for example, an optical adhesive having a substantially intermediate refractive index between the refractive index of the prism 16 and the refractive index of the light transmitting substrate 3.

In this embodiment, the length of the first surface 16*a* in the longitudinal direction matches the diameter of the light transmitting substrate 3. Specifically, the positions of both end portions of the first surface 16*a* in the longitudinal direction match the positions of the edge portions of the light transmitting substrate 3 as viewed from a direction (Z-axis direction) perpendicular to the first surface 16*a*. Since an end portion connected to the second surface 16*b* in the first surface 16*a* is not located on the inside in relation to the edge portion of the light transmitting substrate 3, the second surface 16*b* can be brought into contact with the inner surface 32*c* of the ceiling wall 32 of the casing 31 at the time of disposing the electron tube 1A inside the casing 31 of the electron tube module 30 (see FIG. 2). However, when there is no need to dispose the electron tube 1A inside the casing 31 in this way, an end portion connected to the second surface 16*b* in the first surface 16*a* may be located on the inside in relation to the edge portion of the light transmitting substrate 3.

The third surface 16*c* of the prism 16 is provided with a reflection film 19 for improving the reflectance of light. The reflection film 19 can be formed of, for example, aluminum, an aluminum alloy, silver, a silver alloy, gold, a dielectric multilayer film, or the like.

Figure 5:
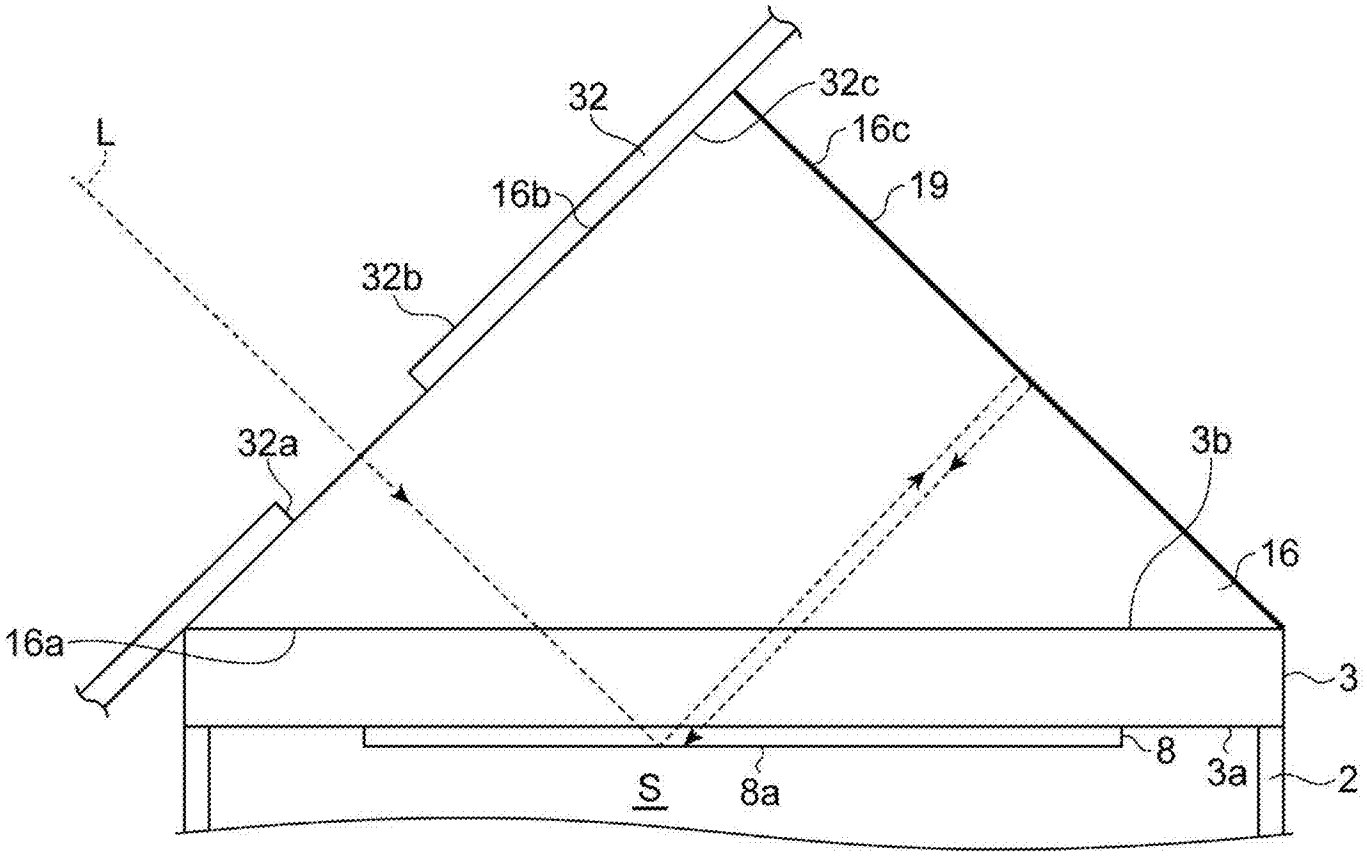
FIG. 5 is a schematic diagram illustrating an optical path of detection target light in the electron tube module.

Referring to FIG. 5, a principle that improves the quantum efficiency of the photocathode 8 by the prism 16 will be described. FIG. 5 schematically illustrates a part of the side tube 2, the light transmitting substrate 3, the photocathode 8, the prism 16, and a part of the ceiling wall 32 among the components of the electron tube 1A. FIG. 5 illustrates a case in which the detection target light L is parallel light directed toward the second surface 16*b* of the prism 16. In this embodiment, the optical axis of the detection target light L is orthogonal to the second surface 16*b*. As illustrated in FIG. 5, the detection target light L is incident to the photocathode 8 through the prism 16 and the light transmitting substrate 3. In this embodiment, the electron tube 1A is disposed with respect to the optical axis of the detection target light L so that the detection target light L is totally reflected at the interface between the vacuum space S and the inner surface 8*a* on the side of the vacuum space S of the photocathode 8 (that is, the following equation (3) is satisfied). In this case, the detection target light L is totally reflected at the interface between the inner surface 8*a* of the photocathode 8 and the vacuum space S so as to be directed toward the third surface 16*c* of the prism 16. The detection target light L is reflected at the third surface 16*c* of the prism 16 provided with the reflection film 19 so as to be directed toward the photocathode 8 again.

Figure 6:
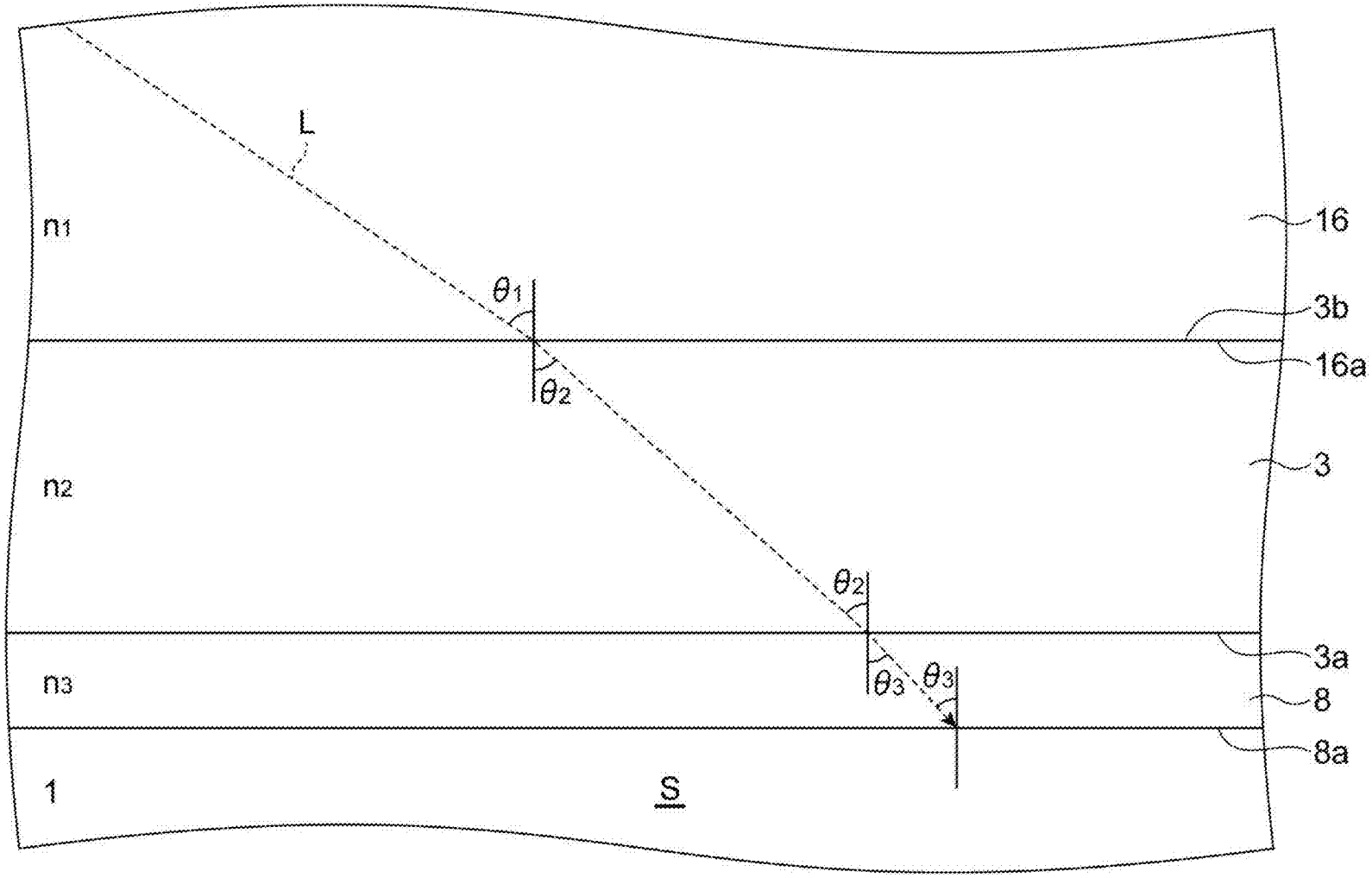
FIG. 6 is a schematic diagram for describing a condition for totally reflecting the detection target light at an interface between a photocathode and a vacuum space.

Referring to FIG. 6, a condition that the detection target light L is totally reflected at the interface between the inner surface 8*a* of the photocathode 8 and the vacuum space S will be described. Here, the refractive index of the prism 16 is set to $n_1$ (>1), the refractive index of the light transmitting substrate 3 is set to $n_2$ (>1), and the refractive index of the photocathode 8 is set to $n_3$ (>1). The refractive index of the vacuum space S is 1. Further, the incident angle of the detection target light L incident from the prism 16 to the light transmitting substrate 3 is set to $\theta_1$, the incident angle of the detection target light L incident from the light transmitting substrate 3 to the photocathode 8 is set to $\theta_2$, and the incident angle of the detection target light L incident from the photocathode 8 to the vacuum space S is set to $\theta_3$. Further, the critical angle of the detection target light L incident from the photocathode 8 to the vacuum space S (a minimum incident angle in which a total reflection occurs at the interface between the photocathode 8 and the vacuum space S) is set to $\theta_0$. In this case, the following equations (1) and (2) are established. Then, a condition that the detection target light L is totally reflected at the interface between the inner surface 8*a* of the photocathode 8 and the vacuum space S is expressed by the equation (3). Thus, in order to totally reflect the detection target light L at the interface between the inner surface 8*a* of the photocathode 8 and the vacuum space S, the electron tube 1A may be disposed with respect to the optical axis of the detection target light L so that $\theta_3$ determined based on the incident angle $\theta_1$ with respect to the light transmitting substrate 3 of the detection target light L satisfies the following equation (3).

$$n_1 \sin \theta_1 = n_2 \sin \theta_2 = n_3 \sin \theta_3 \quad (1)$$

$$n_3 \sin \theta_0 = 1 \quad (2)$$

$$\theta_3 \geq \theta_0 \quad (3)$$

Returning to FIG. 2, a positional relationship between the electron tube 1A and the casing 31 of the electron tube module 30 will be described. The electron tube 1A is disposed inside the casing 31 so that the second surface 16*b* of the prism 16 is parallel to the ceiling wall 32 and at least a part of the second surface 16*b* of the prism 16 is exposed to the outside through the opening 32*a*. The second surface 16*b* of the prism 16 is in contact with the inner surface 32*c* of the ceiling wall 32. Accordingly, the electron tube 1A can be easily and highly accurately positioned inside the casing 31 so that the second surface 16*b* is parallel to the ceiling wall 32 (the inner surface 32*c*). Furthermore, when an end portion of the first surface 16*a* (an end portion on the connection side to the second surface 16*b*) is located on the inner side in relation to the edge portion of the light transmitting substrate 3 as viewed from the direction along the central axis AX2, the edge portion of the light transmitting substrate 3 interferes with the ceiling wall 32, so that a gap is formed between the second surface 16*b* and the inner surface 32*c* of the ceiling wall 32. In such a case, a spacer member for filling the gap may be disposed between the inner surface 32*c* of the ceiling wall 32 and the second surface 16*b*. Alternatively, the inner surface 32*c* of the ceiling wall 32 may be brought into contact with the second surface 16*b* as the thickness of the ceiling wall 32 in a portion corresponding to the gap becomes larger than the thickness of the other portion.

In this embodiment, the second surface 16*b* of the prism 16 is bonded to the inner surface 32*c* of the ceiling wall 32. The second surface 16*b* and the inner surface 32*c* can be bonded to each other by, for example, an adhesive. As the adhesive, for example, an adhesive for glass bonding such as a silicone-based adhesive may be used. Here, in order to improve the familiarity between the inner surface 32*c* and the adhesive for glass bonding, a primer suitable for the material of the inner surface 32*c* may be applied to the inner surface 32*c* in advance. In this case, after the primer applied to the inner surface 32*c* is dried, the inner surface 32*c* to which the primer is applied and the second surface 16*b* are bonded by an adhesive for glass bonding. Alternatively, an adhesive that is familiar with the material of the inner surface 32*c* may be used as the adhesive. In this case, a glass primer may be applied to the second surface 16*b* in advance in order to improve the familiarity between the second surface 16*b* and the adhesive. However, it is not essential to use primers as described above. In this way, when the prism 16 of the electron tube 1A is fixed to the ceiling wall 32, the positional deviation of the electron tube 1A with respect to the ceiling wall 32 can be appropriately prevented. Furthermore, the entire portion contacting the inner surface 32*c* in the second surface 16*b* may be bonded to the inner surface 32*c* or a part of the portion contacting the inner surface 32*c* in the second surface 16*b* may be bonded to the inner surface 32*c*. Further, the second surface 16*b* may not be essentially bonded to the inner surface 32*c* of the ceiling wall 32 and the electron tube 1A may be fixed to the casing 31 in a portion other than the second surface 16*b*.

According to the above-described electron tube module 30, the detection target light which is incident from the second surface 16*b* of the prism 16 and is transmitted through the prism 16 and the light transmitting substrate 3 can be reflected at the interface between the photocathode 8 and the vacuum space S, and the reflected light can be further reflected by the third surface 16*c* of the prism 16 to be incident to the photocathode 8 again. Accordingly, it is possible to increase the absorption amount of the detection target light of the photocathode 8. Further, when the detection target light L is obliquely incident to the photocathode 8, it is possible to also increase the optical path length of the detection target light L inside the photocathode 8 as compared with a case in which the detection target light L is perpendicularly incident to the photocathode 8. Further, when the electron tube module 30 is disposed so that the incident angle $\theta_3$ of the detection target light L incident from the photocathode 8 to the vacuum space S becomes larger than the critical angle $\theta_0$, it is possible to reduce the transmission loss due to a problem that a part of the detection target light L is not reflected at the interface between the photocathode 8 and the vacuum space S and is transmitted through the vacuum space S. Thus, according to the electron tube module 30, it is possible to increase the light amount of the detection target light L absorbed by the photocathode 8.

Accordingly, it is possible to effectively improve the quantum efficiency of the photocathode 8.

Further, in the electron tube module 30, it is possible to appropriately protect the electron tube 1A by accommodating the electron tube 1A inside the casing 31. Further, when the electron tube 1A is accommodated in the casing 31 so that the second surface 16*b* of the prism 16 is parallel to the ceiling wall 32 and at least a part of the second surface 16*b* of the prism 16 is exposed to the outside through the opening 32*a*, it is easy to dispose the electron tube module 30. Specifically, when the position of the electron tube module 30 is adjusted so that the ceiling wall 32 (and the bottom wall 33) of the casing 31 is orthogonal to the optical axis of the detection target light, it is possible to easily and appropriately dispose the electron tube module 30. Thus, according to the electron tube module 30, it is possible to facilitate the operation of disposing the electron tube 1A in which the prism 16 is provided in the light transmitting substrate 3. Further, since the central axis AX1 of the casing 31 is parallel to the optical axis of the detection target light, it is possible to appropriately dispose the electron tube module 30 in a natural direction in an optical system (optical devices 50A to 50C and the like to be described later) including the electron tube module 30.

Further, the prism 16 is formed in a triangular prism shape of which the first surface 16*a*, the second surface 16*b*, and the third surface 16*c* are side surfaces. Accordingly, it is possible to relatively simplify the shape of the prism 16 and to further reflect the light reflected at the interface between the photocathode 8 and the vacuum space S by the third surface 16*c* so that the light is incident to the photocathode 8 again.

Further, the third surface 16*c* of the prism 16 is provided with the reflection film 19. According to the reflection film 19, since it is possible to reduce the transmission loss of the light at the third surface 16*c* (an element which is transmitted from the third surface 16*c* to the outside), it is possible to effectively improve the quantum efficiency of the photocathode 8.

Further, the electron tube 1A includes the electron multiplying unit 9 which is provided inside the vacuum container 7 and multiplies photoelectrons emitted from the photocathode 8. Accordingly, even when the detection target light L is weak light (such as fluorescence and Raman scattered light generated secondarily by irradiating a sample to be measured with excitation light), it is possible to appropriately detect electrons in response to the detection target light L in the anode 10.

[Modified Example of Electron Tube]

Figure 7:
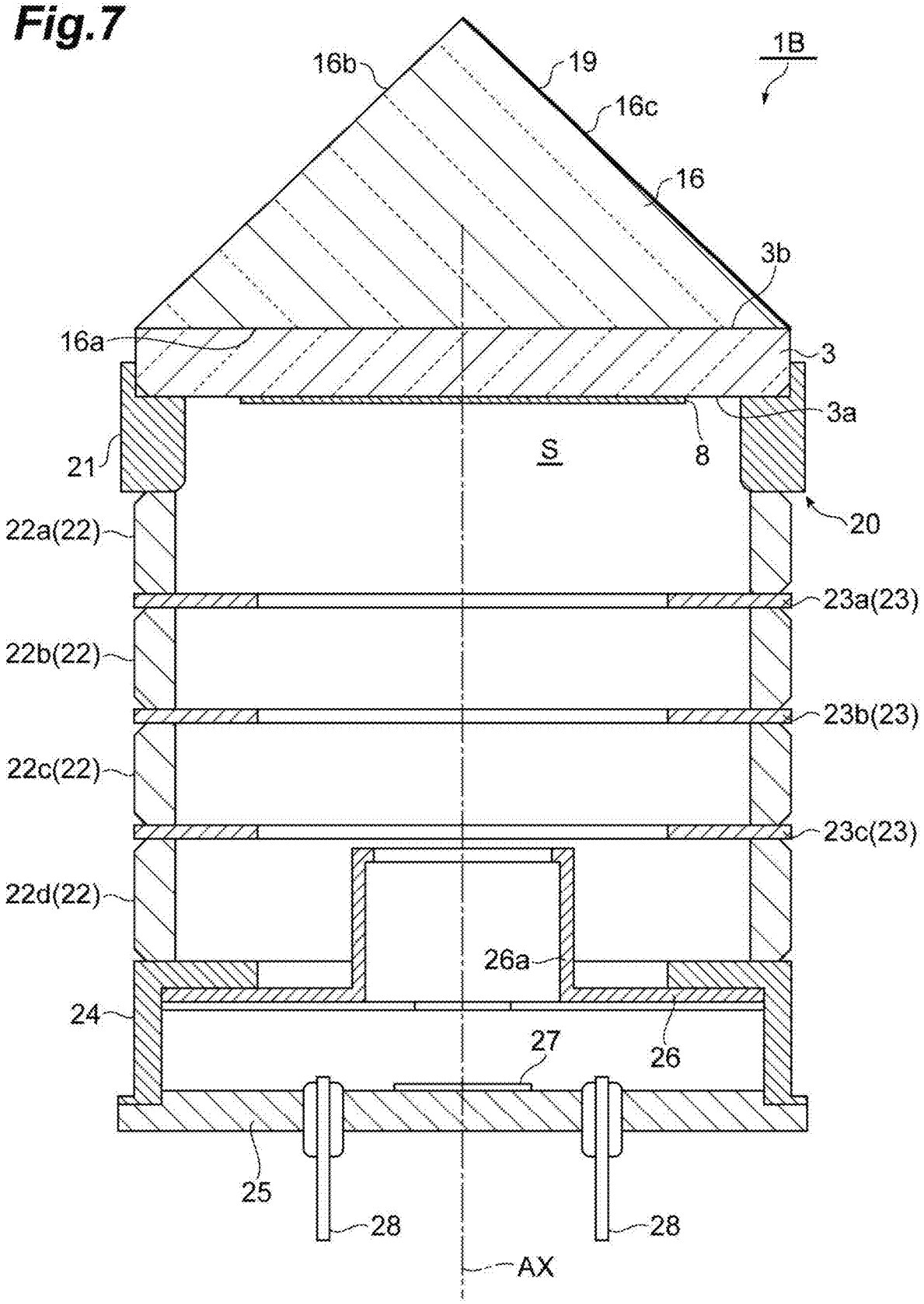
FIG. 7 is a cross-sectional view illustrating a modified example of an electron tube.

Referring to FIG. 7, an electron tube 1B according to a modified example will be described. The electron tube 1B has a configuration different from that of the electron tube 1A in the structure for multiplying photoelectrons emitted from the photocathode 8 (that is, a structure inside the vacuum container). In the configuration of the electron tube 1B, the configurations of the light transmitting substrate 3, the photocathode 8, the prism 16, and the reflection film 19 are the same as those of the electron tube 1A. The electron tube 1B is a so-called electron-bombarded multiplication type photo-detector (hybrid photo-detector (HPD)) which accelerates photoelectrons emitted from the photocathode 8 in response to the incidence of light and obtains a high gain in the semiconductor element so that weak light can be detected.

As illustrated in FIG. 7, the electron tube 1B includes a vacuum container 20 of which an inside is maintained in a vacuum state. In this embodiment, as an example, the vacuum container 20 includes the light transmitting substrate 3, a cylindrical cathode electrode 21, a cylindrical side plate 22 which is formed of an insulation material such as ceramic, an annular intermediate electrode 23*a* which is fixed so as to be sandwiched between a first side plate 22*a* and a second side plate 22*b* formed by dividing the side plate 22 into four parts, an annular intermediate electrode 23*b* which is fixed so as to be sandwiched between the second side plate 22*b* and a third side plate 22*c*, an annular intermediate electrode 23*c* which is fixed so as to be sandwiched between the third side plate 22*c* and a fourth side plate 22*d*, a metal flange 24, and a disk-shaped stem 25 which is airtightly connected to the metal flange 24. The light transmitting substrate 3, the cathode electrode 21, the side plate 22, the intermediate electrode 23, the metal flange 24, and the stem 25 are stacked and arranged concentrically.

The side plate 22 is provided between the cathode electrode 21 and the metal flange 24. One end of the side plate 22 is airtightly bonded to the end surface of the cathode electrode 21 by brazing or the like. The other end of the side plate 22 is airtightly bonded to the metal flange 24 provided in the outer periphery of the stem 25 by brazing or the like. Further, the intermediate electrodes 23*a*, 23*b*, and 23*c* are formed in a ring shape having an opening portion centered on the central axis AX of the vacuum container 20 and are arranged electrically independently from the photocathode 8 at a predetermined interval along the inner wall of the side plate 22. Here, the outer diameters of the cathode electrode 21, the side plate 22, and the cylindrical portions of the metal flange 24 are substantially the same and the inner diameter of the cathode electrode 21 is smaller than the inner diameter of the side plate 22. Thus, the inner wall surface of the cathode electrode 21 is located inside in relation to the inner wall surface of the side plate 22 from one end to the other end of the cathode electrode 21 along the central axis AX. In contrast, the inner diameters of the opening portions of the intermediate electrodes 23*a*, 23*b*, and 23*c* are made as small as possible within a range that does not interfere with the electron trajectory, that is, a range that does not become extremely small compared to the diameter of the photocathode 8 and the intermediate electrodes 23*a*, 23*b*, and 23*c* protrude inward in relation to the cathode electrode 21 from the inner wall surface of the cylindrical side plate 22.

Accordingly, the charging of the side plate 22 by stray electrons when controlling the trajectory of electrons emitted from the photocathode 8 and the influence on the electron trajectory due to the charging can be eliminated. The intermediate electrodes 23*a*, 23*b*, and 23*c* are fixed by brazing or the like while being sandwiched between the side plates 22 so as to be integrated with the side plates 22.

Further, a ring-shaped rising electrode 26 is fixed to the side of the central axis AX of the metal flange 24 of the vacuum container 20. The rising electrode 26 has an opening of a diameter smaller than those of the intermediate electrodes 23*a*, 23*b*, and 23*c* while being disposed concentrically with the metal flange 24. The opening forms a substantially columnar front end portion 26*a* extending along the inner wall of the side plate 22 toward the light transmitting substrate 3.

A semiconductor element 27 (electron detector) including avalanche photodiode (APD) is fixed onto a surface on the side of the vacuum space S in the stem 25 so as to face the photocathode 8. The APD is a semiconductor element which bonds a P region and an N region of a high concentration and forms an electric field high enough for avalanche amplification. When an electron incident surface which is a surface of the semiconductor element 27 is irradiated with photoelectrons emitted from the photocathode 8, the semiconductor element 27 multiplies photoelectrons to be converted into an electrical signal and outputs the signal to the outside through a pin 28 provided through the stem 25.

As described above, in the electron tube 1B, the semiconductor element 27 having a function of multiplying photoelectrons serves as an electron detector. According to the above-described configuration, it is possible to appropriately detect electrons in response to the detection target light in the semiconductor element 27 even when the detection target light is weak light. Further, in the electron tube 1B, since the semiconductor element 27 serving as the electron detector has an electron multiplying function, there is no need to provide the electron multiplying unit 9 in the electron tube 1A of the first embodiment. Furthermore, a detailed structure of the electron tube 1B is not limited to the above-described example. For example, a part of the intermediate electrode 23 may be omitted and the rising electrode 26 may be omitted. Furthermore, the electron tube accommodated in the electron tube module 30 does not need to essentially have the electron multiplying function (the electron multiplying unit 9 or the semiconductor element 27). For example, the electron tube accommodated in the electron tube module 30 may be a photoelectric tube (photoelectric conversion tube) having an anode that directly detects photoelectrons emitted from the photocathode 8 and the photocathode 8 inside the vacuum container.

[Optical Device]

Next, the optical devices 50A to 50C including the electron tube module 30 will be described with reference to FIGS. 8 to 10.

[First Example of Optical Device]

Figure 8:
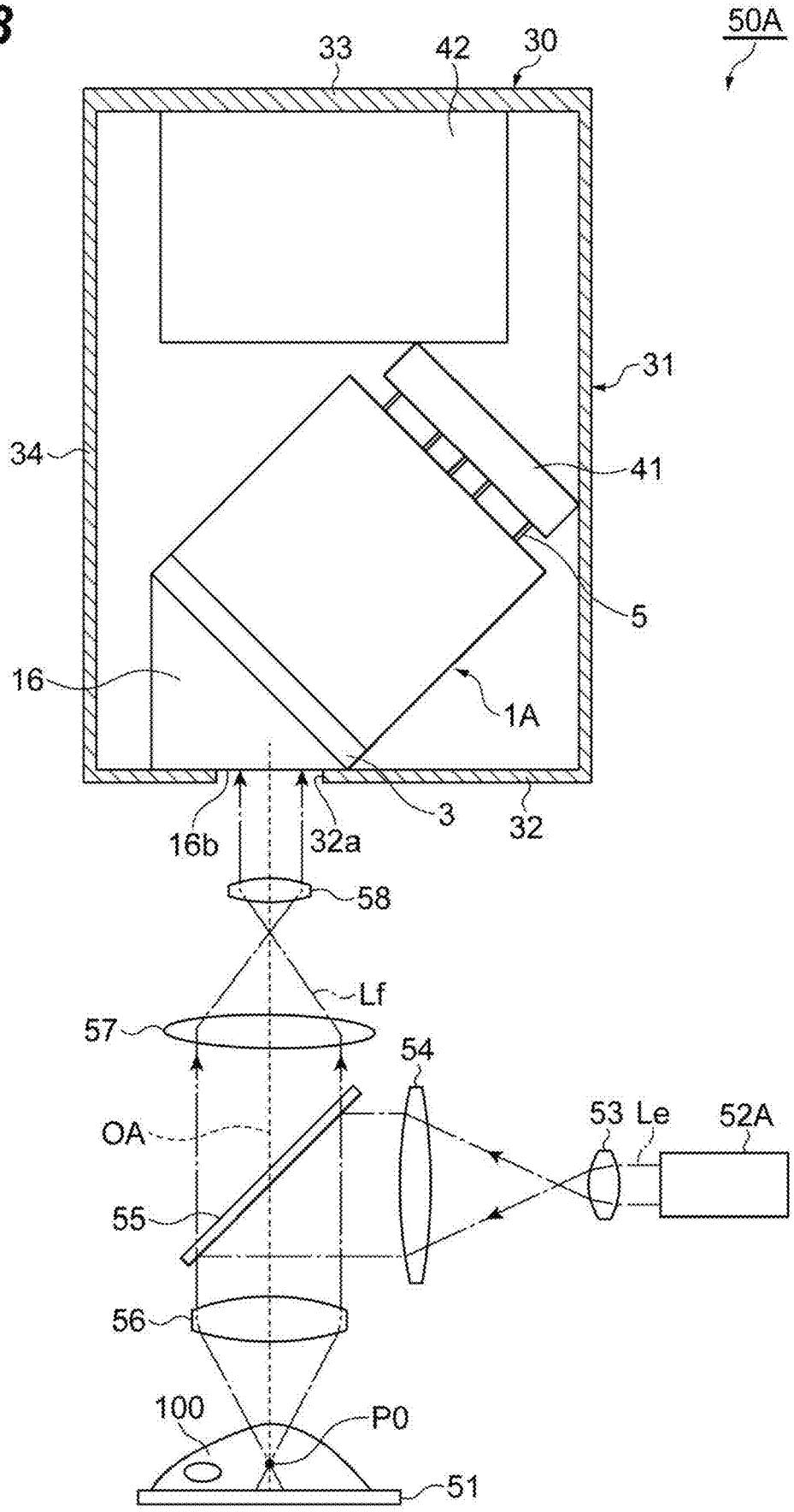
FIG. 8 is a schematic configuration diagram of a first example of an optical device.

As illustrated in FIG. 8, an optical device 50A according to a first example is a two-photon laser microscope (two-photon excitation microscope or two-photon microscope) which irradiates a sample 100 placed on a sample stage 51 with excitation light Le and detects weak fluorescence Lf generated from the sample 100 at a focal position P0 of an objective lens 56.

The optical device 50A includes the sample stage 51, a laser output unit 52 (light source), a condenser lens 53, a collimator lens 54, a dichroic mirror 55, an objective lens 56, a condenser lens 57, a collimator lens 58, and the electron tube module 30 detecting the fluorescence Lf.

The sample stage 51 is a portion on which the sample 100 of the measurement object is placed. The sample stage 51 is, for example, a movable stage. The sample 100 is, for example, a biological sample and emits the fluorescence Lf by being irradiated with the excitation light Le. The laser output unit 52 is a light source which outputs the excitation light Le (light) irradiating the sample 100 of the measurement object. The excitation light Le output by the laser output unit 52 is near-infrared ultrashort pulse laser light. In this embodiment, as an example, the excitation light Le output by the laser output unit 52 is parallel light. The condenser lens 53 is disposed on the optical path of the excitation light Le output from the laser output unit 52 and converts the excitation light Le into a point light source by condensing the excitation light Le. The collimator lens 54 is disposed at the rear stage in relation to the condenser lens 53 and parallelizes (collimates) the excitation light Le. The dichroic mirror 55 is a mirror member formed so that the excitation light Le is reflected and the fluorescence Lf is transmitted and is disposed at the rear stage of the collimator lens 54. The excitation light Le which becomes parallel light by the collimator lens 54 is reflected at the dichroic mirror 55, passes through the objective lens 56, and reaches the sample 100. Accordingly, two-photon excitation is generated only at the focal position P0 of the objective lens 56 and the fluorescence Lf is generated from the sample 100 at the focal position P0.

The fluorescence Lf generated in the sample 100 follows a path opposite to the excitation light Le, passes through the objective lens 56, and is transmitted through the dichroic mirror 55. Then, the fluorescence Lf is condensed by the condenser lens 57. The fluorescence Lf condensed by the condenser lens 57 is parallelized by the collimator lens 58 disposed behind the condensing point of the condenser lens 57. As illustrated in FIG. 8, the electron tube module 30 is disposed at the rear stage of the collimator lens 58 so that the optical axis OA of the fluorescence Lf generated in the sample 100 is orthogonal to the second surface 16*b* of the prism 16. Further, the fluorescence Lf is parallelized by the collimator lens 58 so as to enter the opening 32*a* of the ceiling wall 32. The fluorescence Lf which is parallelized in this way is incident to the second surface 16*b* of the prism 16 through the opening 32*a* and is detected by the electron tube module 30.

The optical device 50A has the same effect as that of the electron tube module 30 by including the electron tube module 30 as a detector which detects the detection target light (here, fluorescence Lf). That is, it is possible to effectively improve the quantum efficiency of the photocathode 8 in the electron tube 1A by using the prism 16. As a result, it is possible to appropriately detect electrons in response to the fluorescence Lf in the anode 10 of the electron tube 1A. Further, as illustrated in FIG. 8, since the electron tube 1A is accommodated in the casing 31, the electron tube module 30 can be disposed in an accommodation state so that the central axis AX1 (see FIG. 2) of the casing 31 is parallel to the optical axis OA of the detection target light (the fluorescence Lf) in the optical device 50A.

Further, in the optical device 50A, the electron tube 1A may be configured so that the fluorescence Lf (the detection target light) incident to the photocathode 8 through the prism 16 and the light transmitting substrate 3 is totally reflected at the interface between the photocathode 8 and the vacuum space S. Specifically, the electron tube 1A may be configured and disposed in the optical device 50A so that the above-described equation (3) is established for the fluorescence Lf as the detection target light L in FIG. 5. In this case, it is possible to increase the absorption amount of the fluorescence Lf in the photocathode 8 by the fluorescence Lf totally reflected at the interface between the photocathode 8 and the vacuum space S and returning to the photocathode 8 again and to effectively improve the quantum efficiency of the photocathode 8.

[Second Example of Optical Device]

Figure 9:
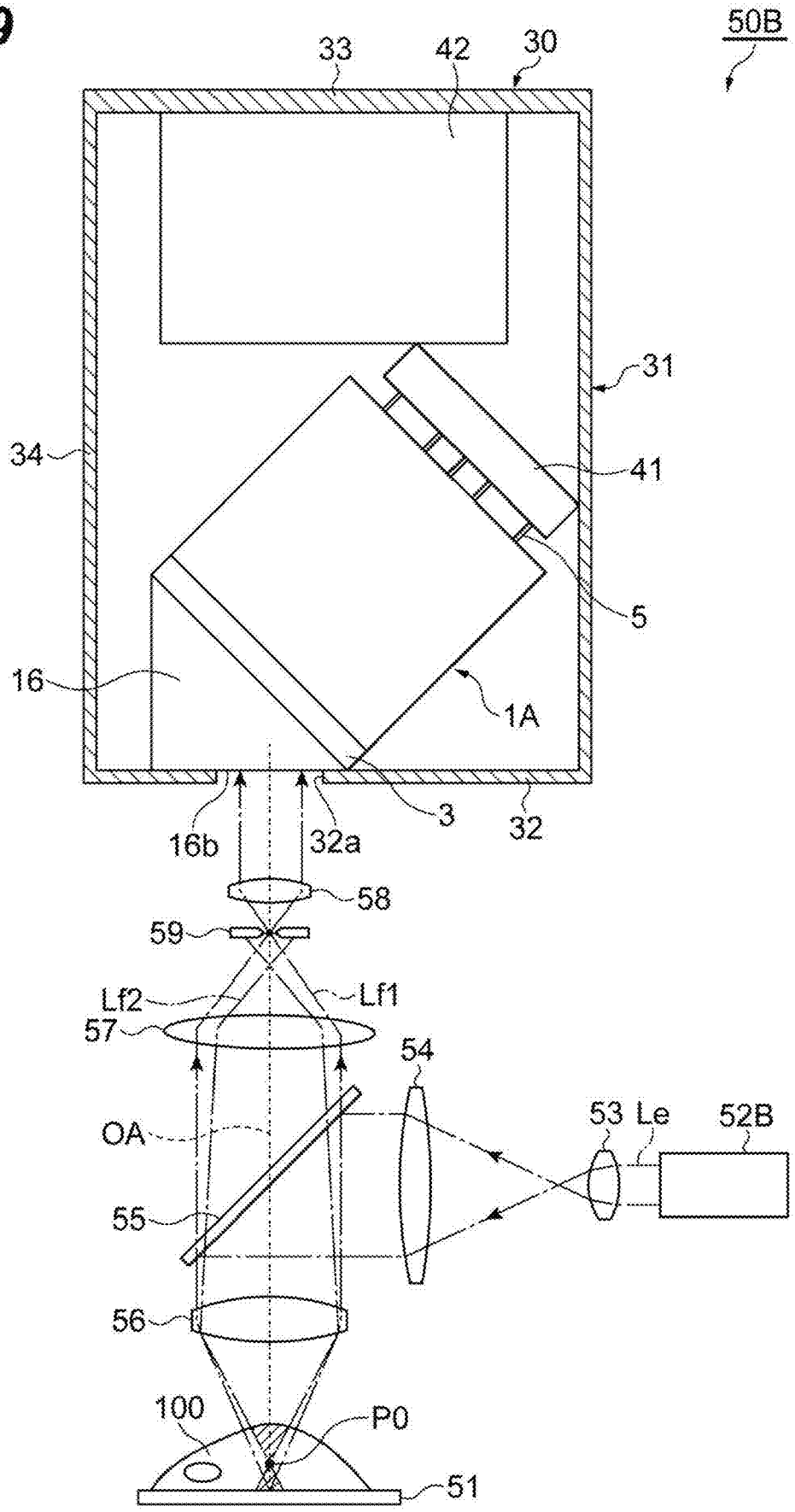
FIG. 9 is a schematic configuration diagram of a second example of the optical device.

As illustrated in FIG. 9, an optical device 50B according to a second example is a confocal laser microscope which irradiates the sample 100 placed on the sample stage 51 with the excitation light Le and detects weak fluorescence Lf1 generated from the sample 100 at the focal position P0 of the objective lens 56. The optical device 50B is different from the optical device 50A in that a laser irradiation unit 52B is provided instead of the laser irradiation unit 52A and a pin hole 59 is further provided and the other configurations are the same as those of the optical device 50A.

Specifically, the excitation light Le output by the laser irradiation unit 52A is a visible ultraviolet laser. In this case, when the sample 100 is irradiated with the excitation light Le, fluorescence is generated from an irradiation region including a region other than the focal position P0 of the objective lens 56. In FIG. 9, the fluorescence Lf1 indicates the fluorescence generated at the focal position P0 and the fluorescence Lf2 indicates the fluorescence generated at a position (here, as an example, in the vicinity of the contact position between the sample 100 and the sample stage 51) other than the focal position P0. In this way, in the optical device 50B, since the fluorescence Lf2 is also generated in a region other than the focal position P0, the pin hole 59 through which only the fluorescence Lf1 generated from the focal position P0 passes is provided at the rear stage of the condenser lens 57. Accordingly, only the fluorescence Lf1 passes through the pin hole 59 and is guided to the incident surface (the second surface 16*b* of the prism 16) of the electron tube module 30 through the collimator lens 58. That is, the pin hole 59 shields the fluorescence Lf2 generated in a region other than the focal position P0. Also in the optical device 50B, the same effect as that of the optical device 50A is obtained.

[Third Example of Optical Device]

Figure 10:
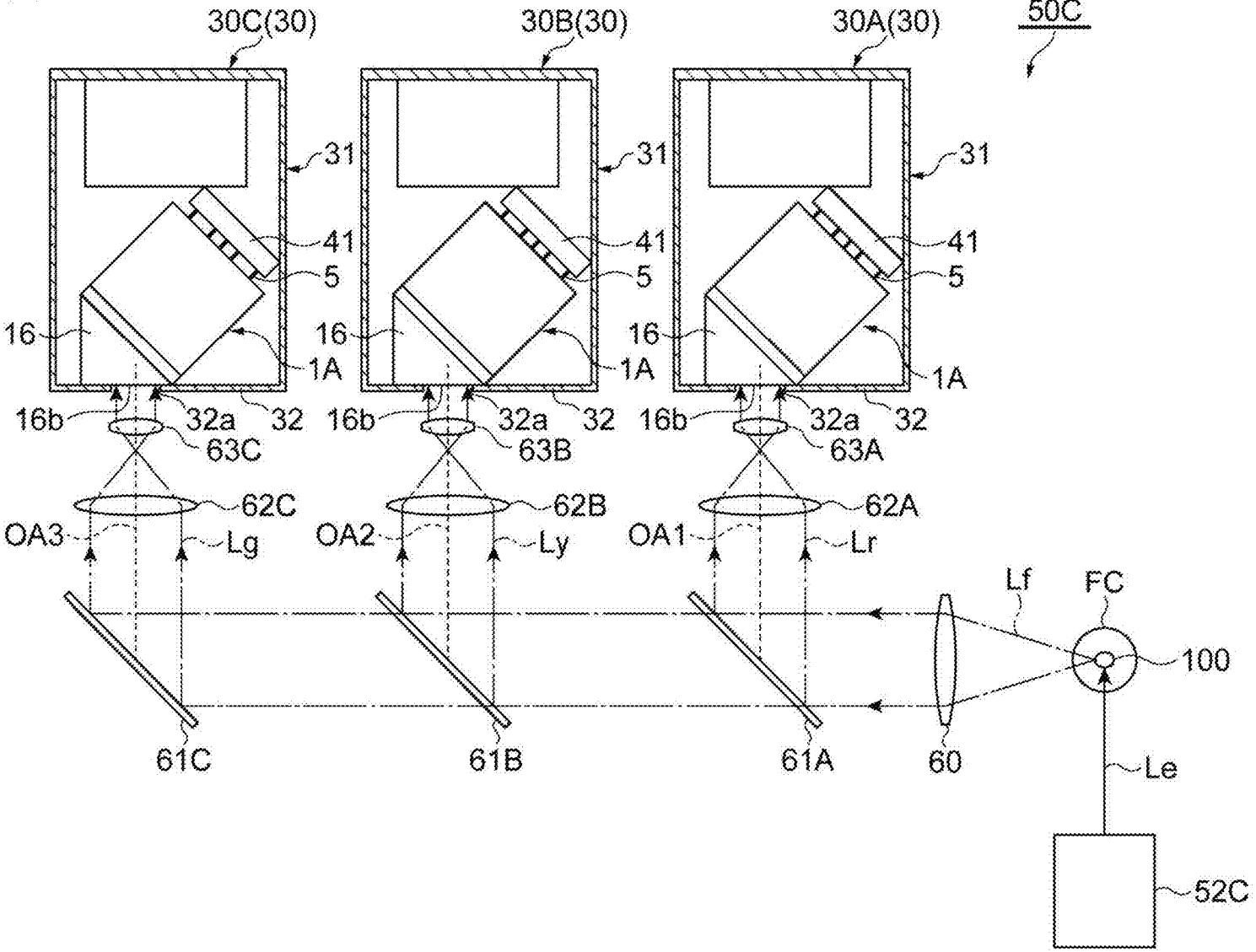
FIG. 10 is a schematic configuration diagram of a third example of the optical device.

As illustrated in FIG. 10, an optical device 50C according to a third example is a device (flow cytometer) that performs flow cytometry. The optical device 50C includes a laser irradiation unit 52C, a flow cell FC, a collimator lens 60, a plurality of (here, as an example, three) dichroic mirrors 61A, 61B, and 61C, a plurality of condenser lenses 62A, 62B, and 62C, a plurality of collimator lenses 63A, 63B, and 63C, and a plurality of electron tube modules 30A, 30B, and 30C.

The flow cell FC is a device that distributes a sample solution including the sample 100 such as a plurality of cells to be measured. The flow cell FC has a function of aligning the sample 100 in the sample solution so that the samples 100 sequentially flow one by one. The laser irradiation unit 52C is configured to irradiate a predetermined irradiation position of the flow cell FC with the excitation light Le (here, as an example, a 488 nm argon laser). Accordingly, t each of the samples 100 flowing through the flow cell FC and passing through the irradiation position is sequentially irradiated with the excitation light Le. When the sample 100 is irradiated with the excitation light Le in this way, the fluorescence Lf is generated in the sample 100.

The collimator lens 60 parallelizes the fluorescence Lf generated in the sample 100. The dichroic mirrors 61A, 61B, and 61C are disposed in this order at the rear stage of the collimator lens 60. Here, as an example, the dichroic mirror 61A of the first stage is configured to reflect the red light Lr and transmit light having a shorter wavelength than the red light Lr. The dichroic mirror 61B of the second stage disposed at the rear stage of the dichroic mirror 61A is configured to reflect the yellow light Ly in the light transmitted through the dichroic mirror 61A and transmit light having a shorter wavelength than the yellow light Ly. The dichroic mirror 61C of the third stage disposed at the rear stage of the dichroic mirror 61B is configured to reflect the green light Lg in the light transmitted through the dichroic mirror 61B and transmit light having a shorter wavelength than the green light Lg.

The condenser lens 62A, the collimator lens 63A, and the electron tube module 30A are disposed on the optical path of the red light Lr reflected by the dichroic mirror 61A. That is, the dichroic mirror 61A, the condenser lens 62A, the collimator lens 63A, and the electron tube module 30A constitute an optical system that detects the red light Lr included in the fluorescence Lf. The electron tube module 30A is disposed at the rear stage of the collimator lens 63A so that the optical axis OA1 of the red light Lr reflected by the dichroic mirror 61A is orthogonal to the second surface 16*b* of the prism 16. The red light Lr is parallelized by the condenser lens 62A and the collimator lens 63A so as to enter the opening 32*a* of the ceiling wall 32. The red light Lr parallelized in this way is incident to the second surface 16*b* of the prism 16 through the opening 32*a* and is detected by the electron tube module 30A.

The condenser lens 62B, the collimator lens 63B, and the electron tube module 30B are disposed on the optical path of the yellow light Ly reflected by the dichroic mirror 61B. That is, the dichroic mirror 61B, the condenser lens 62B, the collimator lens 63B, and the electron tube module 30B constitute an optical system that detects the yellow light Ly included in the fluorescence Lf. The electron tube module 30B is disposed at the rear stage of the collimator lens 63B so that the optical axis OA2 of the yellow light Ly reflected by the dichroic mirror 61B is orthogonal to the second surface 16*b* of the prism 16. The yellow light Ly is parallelized by the condenser lens 62B and the collimator lens 63B so as to enter the opening 32*a* of the ceiling wall 32. The yellow light Ly parallelized in this way is incident to the second surface 16*b* of the prism 16 through the opening 32*a* and is detected by the electron tube module 30B.

The condenser lens 62C, the collimator lens 63C, and the electron tube module 30C are disposed on the optical path of the green light Lg reflected by the dichroic mirror 61C. That is, the dichroic mirror 61C, the condenser lens 62C, the collimator lens 63C, and the electron tube module 30C constitute an optical system that detects the green light Lg included in the fluorescence Lf. The electron tube module 30C is disposed at the rear stage of the collimator lens 63C so that the optical axis OA3 of the green light Lg reflected by the dichroic mirror 61C is orthogonal to the second surface 16*b* of the prism 16. The green light Lg is parallelized by the condenser lens 62C and the collimator lens 63C so as to enter the opening 32*a* of the ceiling wall 32. The green light Lg which is parallelized in this way is incident to the second surface 16*b* of the prism 16 through the opening 32*a* and is detected by the electron tube module 30C.

Although an embodiment of the present disclosure has been described above, the present disclosure is not limited to the above-described embodiment. For example, the materials and shapes of the components are not limited to the materials and shapes described above and various materials and shapes can be employed. For example, the electron tube module 30 may be assembled to the optical device other than the optical devices 50A, 50B, and 50C exemplified in the present disclosure. That is, the electron tube module 30 may be used for applications other than the two-photon laser microscope, the confocal laser microscope, and the flow cytometer. Further, the prism included in the electron tube is not limited to the triangular prism 16 and may have other shapes such as a square prism. That is, the prism included in the electron tube is not limited to a particular shape as long as the light reflected at the interface between the photocathode 8 and the vacuum space S is further reflected so that the light is incident to the photocathode 8 again.

What is claimed is:

1. An electron tube module comprising:

an electron tube; and a casing which accommodates the electron tube, wherein the electron tube includes:

a vacuum container which includes a light transmitting substrate and forms a vacuum space;

a photocathode provided in an inner surface corresponding to a surface on a side of the vacuum space of the light transmitting substrate and configured to emit photoelectrons into the vacuum space in response to the light incident through the light transmitting substrate;

an electron detector provided inside the vacuum container and configured to detect electrons derived from the photoelectrons; and a prism bonded to an outer surface on a side opposite to the inner surface of the light transmitting substrate, wherein the prism includes:

a first surface bonded to the outer surface of the light transmitting substrate;

a second surface which is a light incident surface inclined with respect to the first surface; and a reflection portion configured to further reflect light incident to the photocathode through the prism and the light transmitting substrate and reflected at an interface between the photocathode and the vacuum space so that the light is incident to the photocathode again, wherein the casing includes a wall portion provided with an opening, wherein the second surface of the prism is parallel to the wall portion, and wherein at least a part of the second surface of the prism is exposed to outside through the opening.

2. The electron tube module according to claim 1, wherein the second surface of the prism is in contact with an inner surface of the wall portion.

3. The electron tube module according to claim 2, wherein the second surface of the prism is bonded to the inner surface of the wall portion.

4. The electron tube module according to claim 1, wherein the reflection portion is configured by a third surface connected to the first surface and the second surface and inclined with respect to the first surface and the second surface, and wherein the prism is formed in a triangular prism shape of which the first surface, the second surface, and the third surface are side surfaces.

5. The electron tube module according to claim 4, wherein the third surface is provided with a reflection film.

6. The electron tube module according to claim 1, wherein the electron tube further includes an electron multiplying unit provided inside the vacuum container and configured to multiply the photoelectrons.

7. The electron tube module according to claim 1, wherein the electron detector is a semiconductor element configured to multiply the photoelectrons.

8. An optical device comprising:

the electron tube module according to claim 1; and a light source configured to output light irradiating a sample of a measurement object, wherein the electron tube module is disposed so that detection target light generated in the sample when the sample is irradiated with the light is incident to the second surface of the prism through the opening of the wall portion.

9. The optical device according to claim 8, wherein the electron tube module is configured so that the detection target light incident to the photocathode through the prism and the light transmitting substrate is totally reflected at an interface between the photocathode and the vacuum space.

* * * * *